US009751274B2

(12) United States Patent
Kobayashi et al.

(10) Patent No.: US 9,751,274 B2
(45) Date of Patent: Sep. 5, 2017

(54) SHEET FOLDING APPARATUS AND IMAGE FORMATION SYSTEM PROVIDED WITH THE APPARATUS

(75) Inventors: Misao Kobayashi, Kofu (JP); Masaki Oshima, Kofu (JP); Yuichi Ichinose, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 1696 days.

(21) Appl. No.: 12/923,103

(22) Filed: Sep. 2, 2010

(65) Prior Publication Data

US 2011/0058875 A1 Mar. 10, 2011

(30) Foreign Application Priority Data

Sep. 9, 2009 (JP) ..... 2009-208138

(51) Int. Cl.
*G03G 15/00* (2006.01)
*B65H 45/18* (2006.01)
*B31F 1/00* (2006.01)

(52) U.S. Cl.
CPC ..... *B31F 1/0012* (2013.01); *B65H 45/18* (2013.01); *G03G 15/6582* (2013.01); *B65H 2801/27* (2013.01); *G03G 15/6544* (2013.01); *G03G 2215/00877* (2013.01)

(58) Field of Classification Search
CPC ..... G03G 15/6582; G03G 15/6544; G03G 2215/00877; B65H 45/18
USPC ..... 399/397, 407, 408, 410; 270/32
IPC ..... B65H 45/14
See application file for complete search history.

(56) References Cited

U.S. PATENT DOCUMENTS

| | | | | |
|---|---|---|---|---|
| 5,080,340 | A | 1/1992 | Hacknauer et al. | |
| 5,108,081 | A | 4/1992 | Russel et al. | |
| 5,108,082 | A | 4/1992 | Shea et al. | |
| 5,165,671 | A * | 11/1992 | Motooka | 270/47 |
| 6,213,456 | B1 * | 4/2001 | Hirano et al. | 270/58.08 |
| 6,929,256 | B2 * | 8/2005 | Kawatsu et al. | 270/37 |

(Continued)

FOREIGN PATENT DOCUMENTS

| | | |
|---|---|---|
| JP | S61-002637 | 1/1986 |
| JP | S61-027853 | 2/1986 |

(Continued)

OTHER PUBLICATIONS

Japan Patent Office, "Office Action for JP 2009-208138", Jun. 7, 2013.

*Primary Examiner* — R. A. Smith
*Assistant Examiner* — John M Royston
(74) *Attorney, Agent, or Firm* — Manabu Kanesaka

(57) ABSTRACT

A sheet folding apparatus for performing folding processing on a sheet in a transporting direction from a carry-in entrance toward a carrying-out exit, has a first transport path for guiding the sheet without performing folding processing; a second transport path for performing folding processing on the sheet; a third transport path for guiding the folded sheet towards the carrying-out exit; and a folding processing device disposed in the second transport path to fold the sheet. The second transport path has a path end portion for guiding the sheet to adjust a folding position of the sheet, a nip point to nip the sheet for folding, and a folded sheet guide path for guiding the folded sheet. The first transport path is arranged between the path end portion of the second transport path and the folding processing device.

20 Claims, 9 Drawing Sheets

(56) References Cited

U.S. PATENT DOCUMENTS

| | | | | |
|---|---|---|---|---|
| 7,207,557 | B2 * | 4/2007 | Kaneko et al. | 270/58.08 |
| 2009/0035016 | A1 * | 2/2009 | Sanmiya et al. | 399/130 |

FOREIGN PATENT DOCUMENTS

| | | |
|---|---|---|
| JP | U H03-35954 | 4/1991 |
| JP | H05-505154 A | 8/1993 |
| JP | H07-117899 | 5/1995 |
| JP | H07-291487 | 11/1995 |
| JP | U H08-5966 | 2/1996 |
| JP | H11-106112 | 4/1999 |
| JP | 2001-002317 | 1/2001 |
| JP | 2004-238201 | 8/2004 |
| JP | 2005-008337 | 1/2005 |
| JP | 2005-231778 | 9/2005 |
| JP | 2005-266245 | 9/2005 |
| JP | 2006-076776 | 3/2006 |
| JP | 2006-076777 | 3/2006 |
| JP | 2006-290618 | 10/2006 |
| JP | 2006-335500 | 12/2006 |
| JP | 2007-015785 | 1/2007 |
| JP | 2007-320665 | 12/2007 |
| JP | 2008-007297 | 1/2008 |
| JP | 2008-184324 | 8/2008 |
| JP | 2008-247531 | 10/2008 |
| JP | 2009-018494 | 1/2009 |

* cited by examiner

SHEET FOLDING APPARATUS AND IMAGE FORMATION SYSTEM PROVIDED WITH THE APPARATUS

BACKGROUND OF THE INVENTION

Technical Field

The present invention relates to a sheet folding apparatus for folding a sheet with an image formed thereon in half, one-third or the like, for example, and more particularly, to improvements in the folding mechanism.

Description of the Related Art

Generally, this type of sheet folding apparatus has been known as an apparatus for folding a sheet with an image formed thereon by a printing press, printer apparatus or the like to perform finish processing, or to perform finish preprocessing. For example, Japanese Patent Application Publication No. 2009-18494 proposes a system in which a sheet folding apparatus is arranged between an image formation apparatus and a bookbinding apparatus, and sheets with images formed are folded by the sheet folding apparatus and undergo a bookbinding finish. Further, Japanese Patent Application Publication No. 2005-266245 discloses a system in which a sheet folding apparatus is arranged between an image formation apparatus and a post-processing apparatus, folds a sheet with an image formed, and feeds the sheet to the post-processing apparatus.

Meanwhile, as a sheet folding mechanism, such a folding mechanism has been used widely that two pairs of rollers fold a sheet in two or three pairs of rollers fold a sheet in three. For example, Japanese Patent Application Publication No. 2006-76777 discloses a folding apparatus for folding a sheet using three pairs of rollers.

The sheet folding apparatus, which folds a sheet fed from the image formation apparatus, etc. in two or three to transfer to the subsequent apparatus as described above, has been known widely as an image formation system, etc. In this case, conventionally, as proposed in Japanese Unexamined Patent Publication No. 2009-18494 and Japanese Unexamined Patent Publication No. 2005-266245, a path for feeding a sheet that does not undergo folding processing from a carry-in entrance to a carrying-out exit is disposed in the horizontal direction, for example, and a sheet folding path for folding a sheet is disposed on the upper or lower side of the path in the apparatus.

Then, the sheet folding path adopts an apparatus configuration in which, for example, a substantially linear path is disposed in the vertical direction, a sheet carried in the path is folded for first folding, the folded sheet is fed to a substantially linear path disposed on the downstream side to undergo second folding, and the folding-finish sheet is finally fed to a post-processing section on the downstream side.

Thus, conventionally, the sheet folding path provided with the folding processing means is disposed in the apparatus upper portion or lower portion of the transport path for guiding a sheet that does not undergo folding processing to the downstream side, and has a substantially linear path configuration. Therefore, the sheet folding path is configured in a path length corresponding to the length size of the maximum sheet, a second folding path is further formed on the downstream side, and a sheet discharge path is disposed sequentially. Accordingly, the sheet folding path is very long and results in increases in size of the apparatus.

Therefore, the inventor of the invention arrived at the idea of providing the transport path for a sheet that does not undergo folding processing and a sheet folding path to partially cross each other, and is thereby enabling the apparatus to be small and compact.

It is a principal object of the invention to provide a sheet folding apparatus for enabling a sheet folding path for performing folding processing on a sequentially fed sheet to carry to the downstream side to be made small and compact.

BRIEF SUMMARY OF THE INVENTION

To attain the above-mentioned object, the invention is characterized by having a first transport path for guiding a sheet from a carry-in entrance to a carrying-out exit without performing folding processing, and a second transport path for performing folding processing on a sheet to guide to the carrying-out exit, where the second transport path is disposed so that a path end portion for positioning a sheet from the carry-in entrance in a folding position of folding processing means and the first transport path cross each other. Further, the invention is characterized in that the second transport path is formed of a substantially loop-shaped path for guiding the sheet from the carry-in entrance to the folding position of the folding processing means, and that the front end portion in the transport direction of the loop-shaped path crosses the first transport path. Thus, by making the second transport path for folding the sheet and the first transport path cross each other, it is possible to achieve miniaturization and compact size of the apparatus.

The configuration will be described specifically. An apparatus for performing folding processing on a sheet from a carry-in entrance (2) to guide to a carrying-out exit is provided with a first transport path (4) for guiding a sheet from the carry-in entrance to the carrying-out exit without performing folding processing, a second transport path (5) for performing folding processing on a sheet from the carry-in entrance to guide to the carrying-out exit, a folding processing means (8) disposed in the second transport path to fold the sheet from the carry-in entrance, and a control means for controlling driving of sheet transport means disposed in the first transport path and the second transport path. Then, the second transport path is configured so that a path end portion (5*b*) for positioning the sheet from the carry-in entrance in a folding position of the folding processing means and the first transport path cross each other.

Advantageous Effect of the Invention

The invention has the following outstanding effects. Since the paths are configured so that the path end portion of the second transport path for performing folding processing on a sheet from the carry-in entrance to guide to the carrying-out exist crosses the first transport path for guiding a sheet to the carrying-out exit without performing folding processing, it is possible to make the apparatus small and compact. In other words, with respect to the first transport path extending from the carry-in entrance to the carrying-out exit, the second transport path is configured so that the path rear end portion is disposed above or below the first transport path, and that the path front end portion crosses the first transport path and is disposed on the opposite side, and it is possible to achieve a compact layout of the second transport path.

Further, in the invention, the first transport path is comprised of a substantially linear path, the second transport path is comprised of a semicircular loop-shaped path, the first and second transport paths can thereby be arranged in the same direction in parallel with each other as compared with the conventional apparatus configuration where the first transport path and second transport path are arranged in the orthogonal direction, and it is possible to downsize the apparatus occupation space.

Accordingly, the first and second transport paths are arranged one above the other in the same direction in parallel with each other, and therefore, the driving mechanism of the transport means disposed on the paths can also be made small and simplified.

DETAILED DESCRIPTION OF THE INVENTION

A sheet folding apparatus according to the invention is coupled to an image formation apparatus, post-processing apparatus and the like, and is configured as a system for performing image formation and finish processing on sheets with images formed thereon, configured alone as a sheet folding apparatus, incorporated into the image formation apparatus as a unit, or incorporated into the post-processing apparatus as a unit. In any of the configurations, the sheet folding apparatus folds a sheet from a carry-in entrance in two, three or the like during the process for conveying the sheet to the carrying-out exit, and transfers the sheet to a storage tray or subsequent apparatus from the carrying-out exit.

[Configuration of the Image Formation System]

Figure 1:
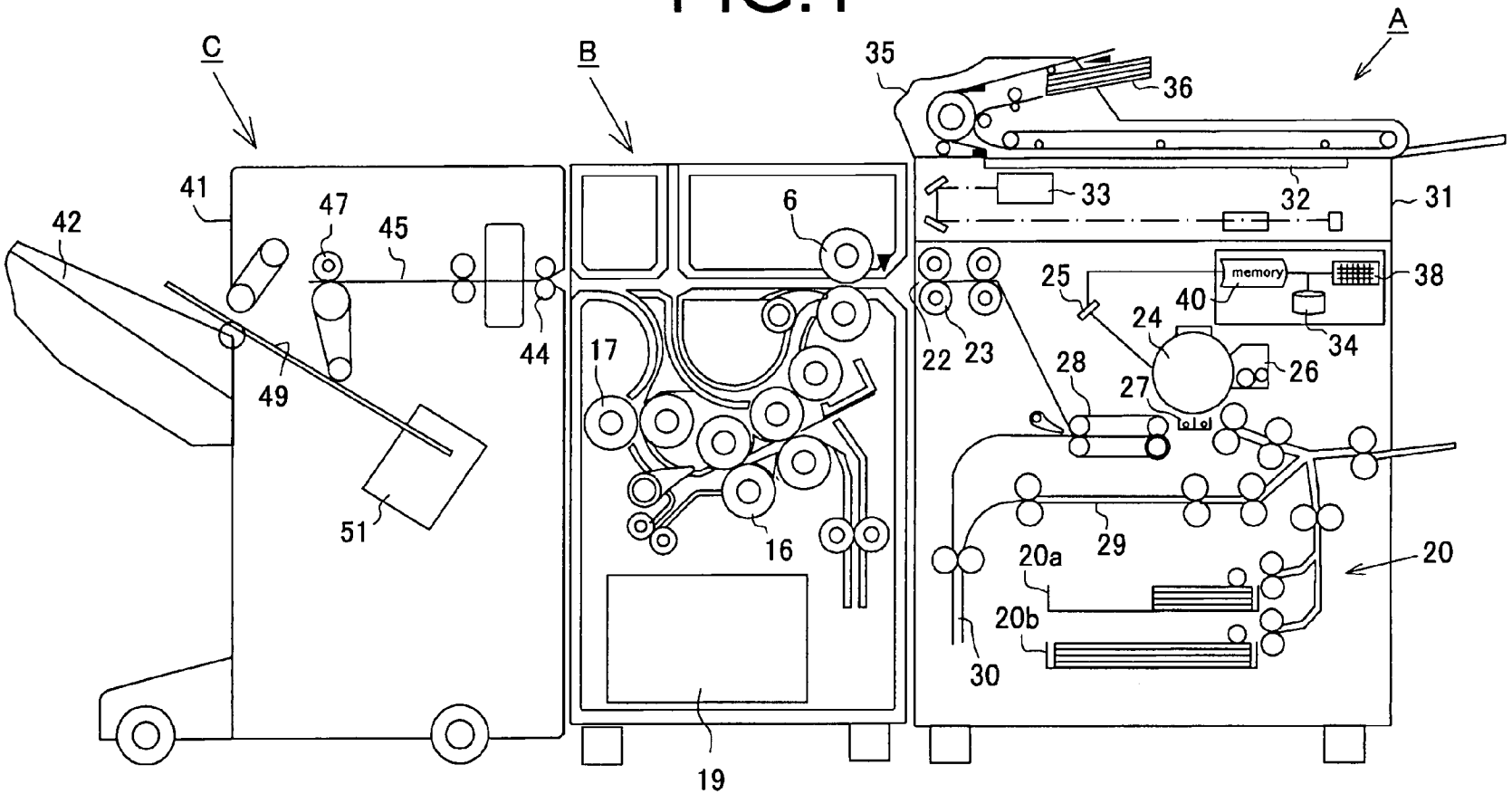
FIG. 1 is an explanatory view of the entire configuration of an image formation system provided with a sheet folding unit of the invention.

FIG. 1 shows an image formation system in which a sheet folding apparatus B is coupled to the downstream side of an image formation apparatus A, and a post-processing apparatus C is coupled to the downstream side of the sheet folding apparatus B. The image formation apparatus A is formed from a printing press, printer, copier, facsimile or the like for forming an image on a sheet based on image data. Further, the sheet folding apparatus B receives the sheet with the image formed from the image formation apparatus A, and folds the sheet in two, three or the like to transfer to the carrying-out exit 3. The post-processing apparatus C is capable of adopting various configurations, and as a typical configuration, a bookbinding finish configuration is shown which collates and collects the folding-processed sheets to bind. The sheet folding apparatus B, image formation apparatus A and post-processing apparatus C will be described below in this order.

[Configuration of the Sheet Folding Apparatus]

Figure 2:
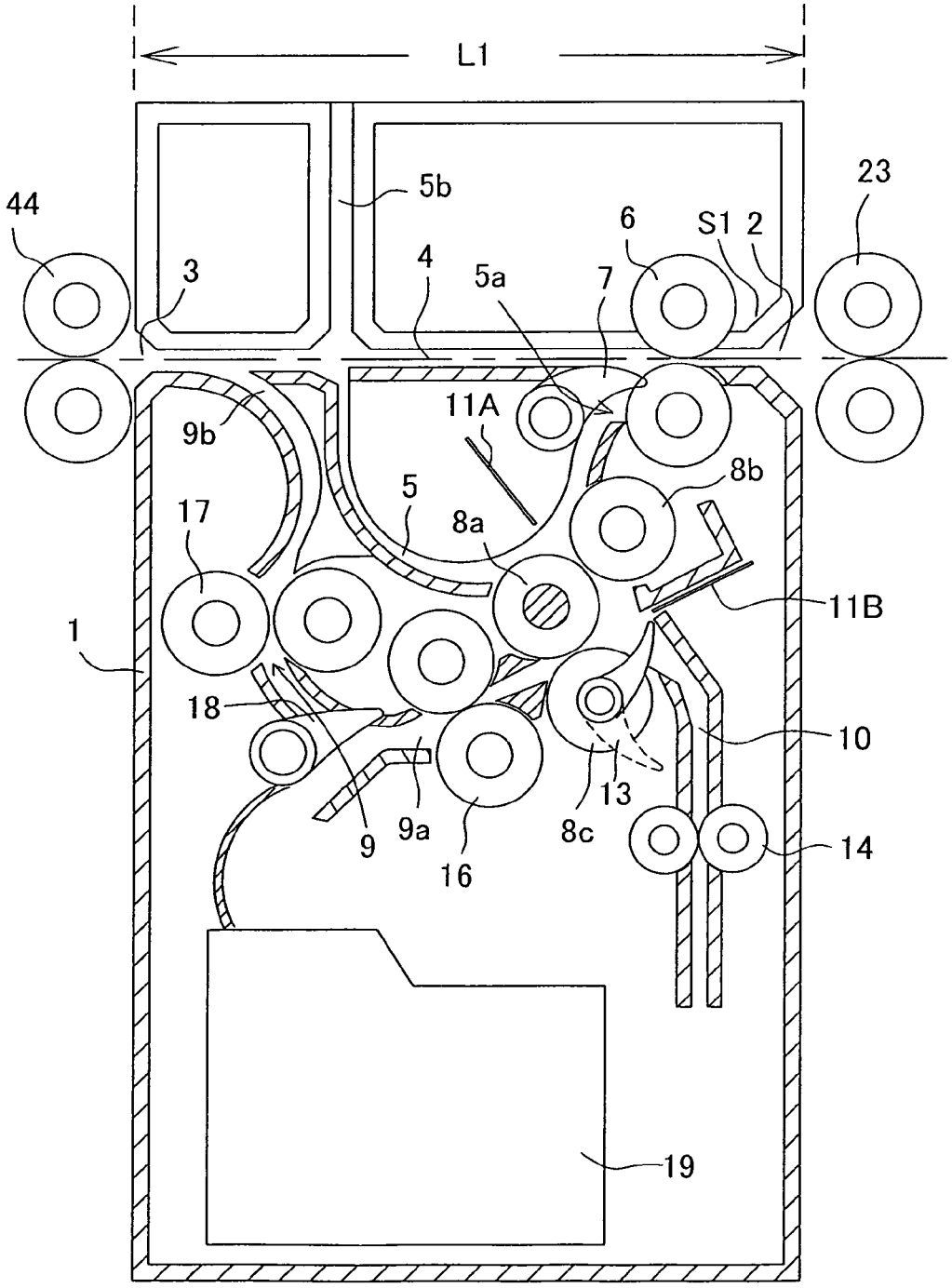
FIG. 2 is an explanatory view of the entire configuration of the sheet folding unit in the system of FIG. 1.

As shown in FIG. 2, the sheet folding apparatus B has an apparatus housing 1 provided with a carry-in entrance 2 and carrying-out exit 3. The carry-in entrance 2 and carrying-out exit 3 are disposed a distance L1 apart from each other. In the apparatus shown in the figure, in relation to a layout where a sheet discharge outlet 22 of the image formation apparatus A and a sheet receiving opening 43 of the post-processing apparatus C are linearly arranged, the carry-in entrance 2 and carrying-out exit 3 are disposed in opposite positions the distance L1 apart in the horizontal direction in FIG. 2. Between the carry-in entrance 2 and carrying-out exit 3 are provided a first transport path 4 for carrying out a sheet without performing folding processing, and a second transport path 5 for performing folding processing on a sheet to carry out.

[First Transport Path]

The first transport path 4 is comprised of a linear path connecting between the carry-in entrance 2 and carrying-out exit 3, and the path shown in the figure is comprised of a path traversing the apparatus housing 1 in the substantially horizontal direction. In the path, a sheet sensor S1 and transport roller 6 are disposed near the carry-in entrance 2. Then, the transport roller 6 is coupled to a driving motor (transport motor) not shown, and carries a sheet from the carry-in entrance 2 to the carrying-out exit 3 in cooperation with a sheet discharge roller 23 of the image formation apparatus A on the upstream side and a carry-in roller 44 of the post-processing apparatus C on the downstream side.

Moreover, the first transport path 4 is coupled to a second transport path 5, described later, branching off from the path 4, and a path switching means 7 is provided in the branch portion. The path switching means 7 is coupled to an electromagnetic solenoid, not shown, and switches the transport direction of the sheet between the first transport path direction and the second transport path direction.

[Second Transport Path]

The second transport path 5 is coupled so that a path rear end portion (on the upstream side in the sheet discharge direction) 5*a* branches off from the carry-in entrance 2 of the first transport path 4, and a path front end portion 5*b* is disposed in the carrying-out exit 3 direction. In other words, the second transport path 5 is configured as a path configuration branching off from the first transport path 4 to run in the same direction as that of the path 4. Concurrently therewith, the path rear end portion 5*a* of the second transport path 5 is disposed above or below the first transport path 4. In the apparatus shown in the figure, the path rear end portion 5*a* is disposed below the first transport path 4.

Then, the second transport path 5 is comprised of a loop-shaped path curved substantially in the shape of a semicircle (the shape of a U), and the path front end portion 5*b* crosses the first transport path 4, and is disposed above the path 4. In other words, as shown in FIG. 2, the second transport path 5 intersects at the path front end portion the first transport path 4 so that the path rear end portion 5*a* is located below the first transport path 4, and that the path front end portion 5*b* is located above the first transport path 4.

The path lengths of thus configured first transport path 4 and second transport path 5 are determined as described below. A path length L1 of the first transport path 4 is set from allowable occupation space of the apparatus housing 1, and is determined by space design for laying each functional component out inside the housing. Further, a path length L2 of the second transport path 5 is determined so that the length from a folding position 8*x* of folding processing means 8 described later to the path front end portion 5*b* is set at a half or more the maximum size sheet (maximum size of a sheet undergoing folding processing). In other words, the path length L2 is set at a path length enabling the sheet center to be set in the folding position 8*x* when the sheet is folded in half.

[Third Transport Path]

The second transport path 5 is connected to a third transport path 9 for guiding a folded sheet from the folding processing means 8, described later, to the carrying-out exit 3. As shown in FIG. 2, in the third transport path 9, a path base end portion 9*a* is disposed on the downstream side of the folding processing means 8, and a path front end portion 9*b* is coupled to the first transport path 4 to guide the folded sheet to the carrying-out exit 3. Then, the third transport path 9 is comprised of a substantially loop-shaped path disposed along the loop outer region of the second transport path 5 in an outer circumferential shape.

By this means, it is possible to arrange the second transport path 5 and the third transport path 9 inside saved space in compact size. In the third transport path 9 are disposed a stacker 19 for storing folded sheets, described later, and sheet discharge rollers 16, 17.

[Folding Means]

The second transport path 5 is provided with the folding processing means 8 for folding a sheet carried into the inside of the path. The folding processing means 8 is disposed in the folding position 8*x* inside the second transport path. The means as shown in the figure is comprised of a folding roller pair 8*a*, 8*b* for performing first folding on the sheet, and a roller pair 8*a*, 8*c* for folding the folded sheet to perform second folding.

Then, the first folding roller 8*a* and the second folding roller 8*b* are disposed in positions facing the second transport path 5 to come into press-contact with each other, and a sheet guided to the second transport path 5 is folded between the rollers (first-folding processing). Further, in an exit end of the folding roller pair 8*a*, 8*b* is disposed a folded sheet guide path 10 for guiding the folded sheet. Then, in the folded sheet guide path 10 is disposed the third folding roller 8*c* coming into press-contact with the first folding roller 8*a*. In a press-contact point between the third folding roller 8*c* and the first folding roller 8*a*, the first-folded sheet undergoes second folding.

The first, second and third rollers 8*a*, 8*b*, 8*c* in press-contact with one another are coupled to a folding roll motor not shown. Driving of the folding rollers is configured so that the first folding roller 8*a* is a driving roller while the second and third folding rollers 8*b*, 8*c* are driven rollers, or that each of the first, second and third rollers 8*a*, 8*b*, 8*c* is coupled to the motor to drive. In addition, as the folding mechanism, a roller pair for first folding and another roller pair for second folding maybe comprised of two separate roller pairs individually.

The folding roller pair 8*a*, 8*b* and the folding roller pair 8*a*, 8*c* are provided with a folding blade mechanism 11 for inserting a fold of the sheet in their press-contact point. This is because of accurately finding a fold position when a sheet is nipped by each folding roller pair and folded, and a knife blade is disposed to be opposed to the roller pair on the opposite side of the roller pair with the sheet sandwiched therebetween, and inserts a fold position of the sheet in the press-contact point.

Figure 3:
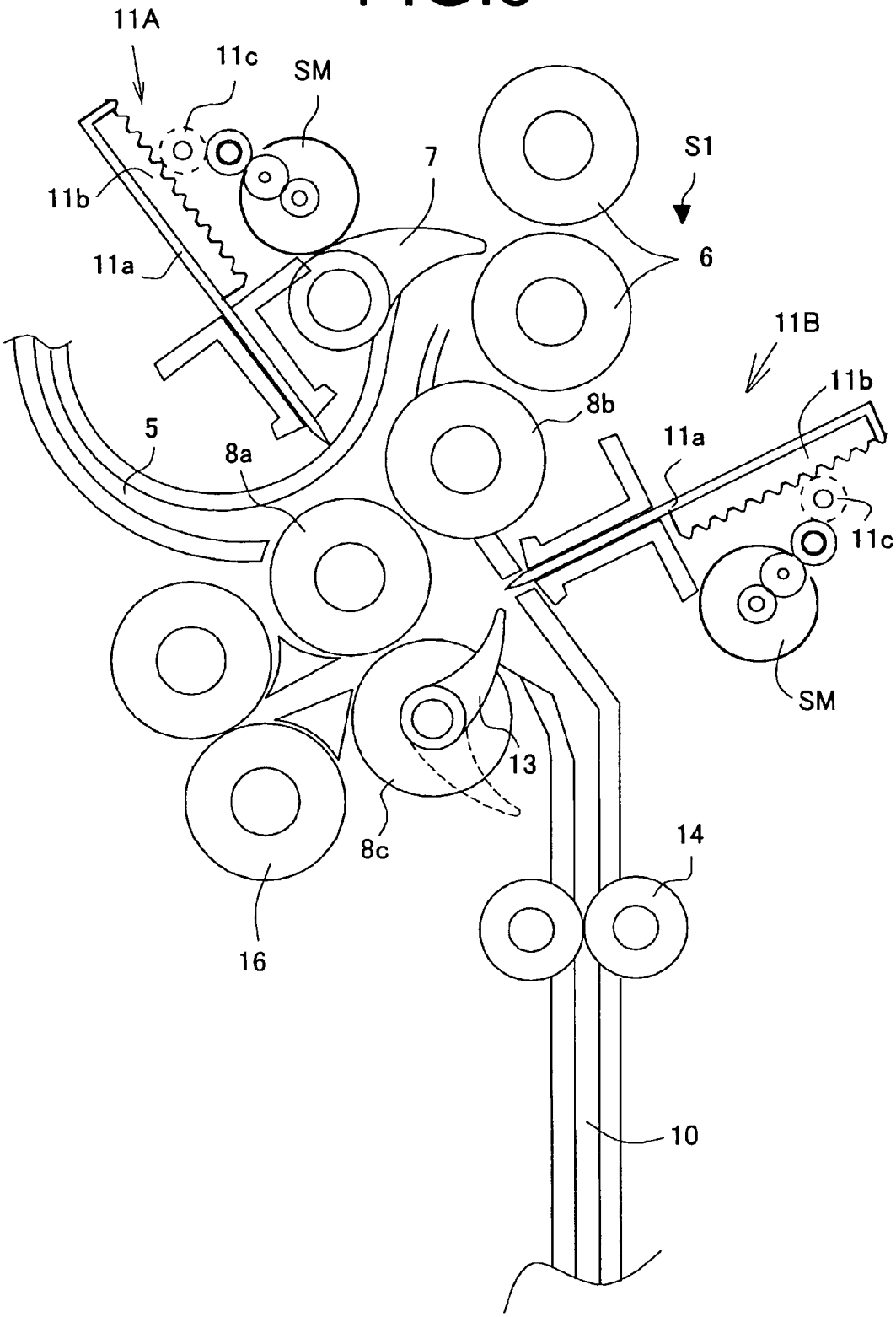
FIG. 3 is a partial explanatory view of a sheet folding mechanism section in the sheet folding unit of FIG. 2.

As the folding blade mechanism 11, as shown in FIG. 3, a folding blade mechanism 11A is disposed in the second transport path 5, a folding blade mechanism 11B is disposed in the folded sheet guide path 10, both mechanisms are of the same structure, and therefore, one of the mechanisms will be described. In the second transport path 5 and the folded sheet guide path 10, a pressing blade 11*a* is supported in a position opposite the roller pair with a sheet sandwiched therebetween by the apparatus frame to be able to reciprocate between a standby position outside the path and an operating position inside the path.

Then, a travel stroke is set so that in the operating position a front end portion of the pressing blade 11*a* pushes the fold position of the sheet guided inside the path in a nip point of the folding roller pair, and that in the standby position the front end retreats outside the path. To abase end portion of the pressing blade 11*a* is integrally attached a rack 11*b*, and the rack 11*b* meshes with a pinion 11*c* coupled to a shift motor SM. Accordingly, by rotating the shift motor SM forward and backward, the pressing blade 11*a* reciprocates between the standby position outside the path and the operating position inside the path.

In addition, the folded sheet guide path 10 is provided with a switchback roller 14 and path switching means 13. The switchback roller 14 is coupled to a driving motor, not shown, and carries the folded sheet in and out of the path. Meanwhile, the path switching means 13 switches the path direction to guide the sheet subjected to first folding by the first and second folding rollers 8*a*, 8*b* to the third transport path 9 (two-folding), or to the folded sheet guide path 10 (three-folding).

In other words, the path switching means 13 is provided with a solenoid, not shown, and is configured to guide the first-folded sheet to the third transport path 9 without any other processing when the means 13 is located inside the path (solid line in FIG. 3), while guiding the first-folded sheet to the folded sheet guide path 10 for second folding when the means 13 is located outside the path (dashed line in FIG. 3).

[Folding Processing Method]

Figure 9A:
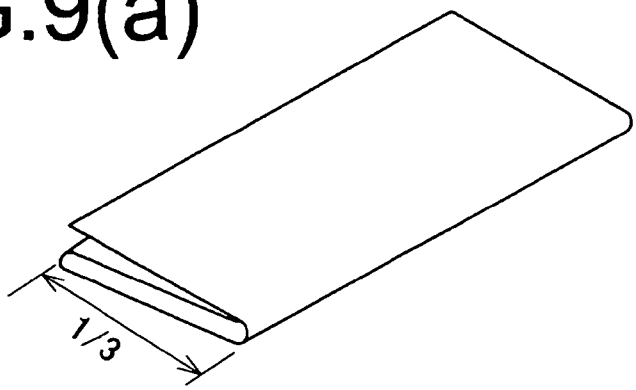
FIG. 9 contains explanatory views of sheet folding forms in the apparatus of FIG. 2, where FIG. 9(*a*) shows inward three-folding, FIG. 9(*b*) shows ⅓ Z-folding, and FIG. 9(*c*) shows ¼ Z-folding.
Figure 9B:
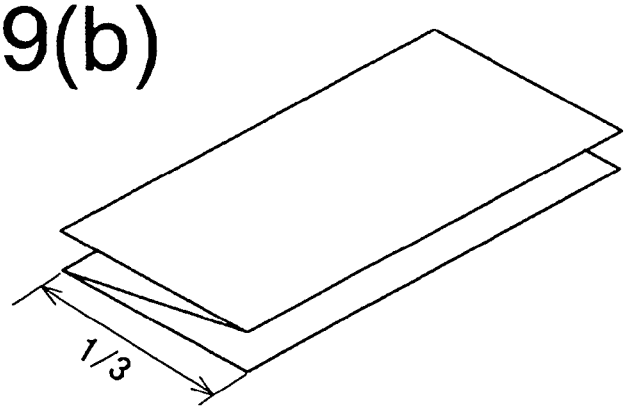
Figure 9C:
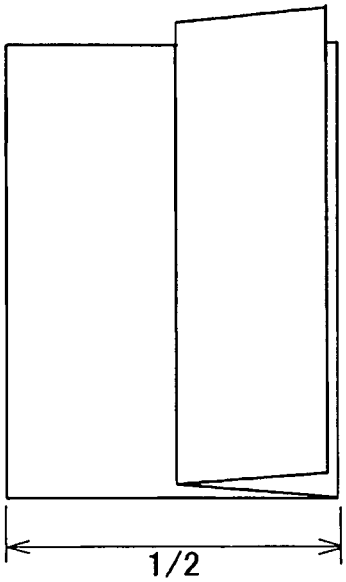

A sheet folding method of the folding processing means 8 will be described next according to FIG. 9. In a normal sheet with the image formed, there are cases that the sheet is folded in two or three with a binding margin left for a filing finish, and that the sheet is folded in two or three for a letter finish. Further, in folding in three, there are cases of z-folding and inward three-folding. FIG. 9(*a*) shows inward three-folding, FIG. 9(*b*) shows ⅓ Z-folding, and FIG. 9(*c*) shows ¼ Z-folding.

Then, in the case of two-folding, the sheet fed to the second transport path 5 is folded in a ½ position of the sheet size or in a ½ position with a binding margin left in the sheet end portion by the first and second folding rollers 8*a*, 8*b* (first folding). Then, the path switching means 13 feeds the folded sheet to the third transport path 9 without feeding the sheet to the folded sheet guide path 10.

Meanwhile, in the case of three-folding, the sheet fed to the second transport path 5 is folded in a ⅓ position of the sheet size or in a ⅓ position with a binding margin left in the sheet end portion by the first and second folding rollers 8*a*, 8*b* (first folding). The folded sheet is fed to the folded sheet guide path 10, and the first and third folding rollers 8*a*, 8*c* fold the remaining sheet in a ⅓ position (second folding) to feed to the third transport path 9.

Further, in the case of three-folding, when inward three-folding is performed as shown in FIG. 9(*a*), the sheet fed to the second transport path 5 is folded in a ⅓ position on the sheet rear end side by the first and second folding rollers 8*a*, 8*b*, and next, is folded in a ⅓ position on the sheet front end side in the folded sheet guide path 10. Similarly, in the case of ⅓ Z-folding, the sheet fed to the second transport path 5 is folded in a ⅓ position on the sheet front end side by the first and second folding rollers 8*a*, 8*b*, and next, is folded in a ⅓ position on the sheet rear end side in the folded sheet guide path 10.

Meanwhile, in ¼ Z-folding as shown in FIG. 9(*c*), the sheet fed to the second transport path 5 is folded in a ¼ position on the sheet rear end side by the first and second folding rollers 8*a*, 8*b*, and next, is folded in a ½ position of the sheet in the folded sheet guide path 10.

[Control Means]

The control means for above-mentioned sheet folding is configured as described below. The sheet folding apparatus B as described previously is mounted with a control CPU, or a control section of the image formation apparatus A is provided with a folding processing control section. Then, the control section is configured to enable the following operation. First, the second transport path 5 and the folded sheet guide path 10 are provided with stopper means (not shown) for regulating a position of the sheet front end, or sensor means (not shown) for detecting a position of the sheet front end. In the case of the stopper means, a stopper member is disposed in the path to be able to travel to positions in the sheet transport direction, and regulates the position of the sheet front end so that the fold position of the sheet coincides with the folding position 8*x*. Various structures of the stopper means are known, and descriptions thereof are omitted.

Meanwhile, in the case of the sensor means, a sensor for detecting the sheet front end is provided in the path, and with reference to a detection signal from the sensor, the transport roller is halted at the predicted time the fold position of the sheet coincides with the folding position 8*x*.

Then, the control means detects timing at which the sheet front end arrives at the carry-in entrance 2 by the sheet sensor S1, and controls the path switching means 7. For control of the path switching means 7, for example, it is configured that an operator sets a folding finish mode of the sheet from a control panel of the image formation apparatus A, or it is configured that the sheet folding apparatus B is provided with a control panel and that an operator sets a folding finish mode of the sheet.

Then, the control means controls the path switching means 7 based on the folding specification instructed from the control panel. In a mode without sheet folding processing (referred to as a "sheet discharge mode"), the means 7 guides the sheet to the first transport path 4, while in a mode with sheet folding (referred to as a "folding processing mode"), guiding the sheet to the second transport path 5. Then, in the sheet discharge mode, the transport roller 6 is rotated in the sheet discharge direction to carry the sheet from the carry-in entrance 2 toward the carrying-out exit 3. In the carrying-out exit 3, the sheet is fed to the post-processing apparatus C in cooperation with the carry-in roller 44 in the sheet receiving opening 43 on the downstream side.

Meanwhile, in the folding processing mode, the path switching means 7 is controlled to guide the sheet to the second transport path 5, and concurrently, according to the folding specification input and set from the control panel, two-folding or three-folding processing is executed as described previously. In two-folding, rotation of the transport roller 6 is controlled so that the fold position of the sheet guided to the second transport path 5 coincides with the folding position 8*x*. Then, in the stage in which the sheet moves to a predetermined position, the shift motor SM is actuated.

Concurrently with (or slightly before) actuation of the shift motor SM, the first, second and third folding rollers 8*a*, 8*b*, 8*c* are driven to rotate by the folding roll motor not shown. The rotation direction is the arrow direction in FIG. 3. In addition, the circumferential velocity of the transport roller 6 and circumferential velocities of the folding rollers 8*a* to 8*c* are set to be the same as one another, and similarly, the velocity acting on the sheet of the pressing blade 11*a* is set to be the same.

Then, the control means guides the folded sheet to a nip point between the first folding roller 8*a* and the third folding roller 8*c* by the path switching means 13 when the folding specification input and set from the control panel is two-folding, and further guides the sheet to the third transport path 9 via this roller pair. Meanwhile, when the folding specification is three-folding, the control means retreats the path switching means 13 outside the path to guide the folded sheet to the folded sheet guide path 10.

In this path, the control means actuates the shift motor SM at timing at which the fold position of the folded sheet coincides with the folding position 8*x* of the first and third folding rollers 8*a*, 8*c*. Concurrently with actuation of the shift motor SM, the control means rotates the switchback roller 14 backward. The operating velocity acting on the sheet of the switchback roller 14 is set at the same as the circumferential velocity of the first and third folding rollers 8*a*, 8*c*. Accordingly, the folded sheet guided to the folded sheet guide path 10 is reversed in the transport direction, guided to the nip point between the first and third folding rollers 8*a*, 8*c*, and is secondary folded by this roller pair.

In addition, in the three-folding specification, Z-folding or inward three-folding is performed by the following folding processing. In Z-folding, the sheet guided to the second transport path 5 is controlled so that a ⅓ position from the sheet front end coincides with the folding position 8*x*, and is folded in the ⅓ position on the sheet front end side. Then, the sheet is carried to the folded sheet guide path 10, fed so that a ⅔ position from the sheet front end coincides with the folding position 8*x*, and then, folded in the ⅓ position on the sheet rear end side by the first and third folding rollers 8*a*, 8*c*. By this means, ⅓ Z-folding is completed.

In inward three-folding, the sheet guided to the second transport path 5 is controlled so that a ⅔ position from the sheet front end coincides with the folding position 8*x*, and is folded in the ⅓ position on the sheet rear end side. Then, the sheet is carried to the folded sheet guide path 10, fed so that a ⅔ position from the sheet front end coincides with the folding position 8*x*, and then, folded in the ⅓ position on the sheet front end side by the first and third folding rollers 8*a*, 8*c*. By this means, inward three-folding is completed.

[Configuration of a Sheet Discharge Path]

Thus folded sheet subjected to two-folding or three-folding as described above is fed to the third transport path 9 from the first and third folding rollers 8*a*, 8*c*. In the third transport path 9, the sheet discharge rollers 16, 17 are disposed and coupled to a sheet discharge motor not shown. Then, the apparatus shown in the figure is provided with the stacker 19 for storing folded sheets from the sheet discharge roller 16 on the upstream side. The stacker 19 stores folded sheets that do not need to be carried to the post-processing apparatus Con the downstream side from the carrying-out exit 3. Therefore, in the third transport path 9 is disposed a path switching means 18.

Then, among folded sheets fed to the third transport path 9, a sheet to be carried to the post-processing apparatus C for post-processing is carried toward the carrying-out exit 3 by the sheet discharge roller 17. In addition, in this case, a determination on whether or not to perform post-processing is configured so that a post-processing condition is set concurrently with the image formation conditions in the control panel as described previously, for example. Then, corresponding to the set finish condition, it is configured that the sheet is carried out to the stacker 19 or transferred to the post-processing apparatus C.

[Image Formation Apparatus]

The image formation apparatus A is provided with the following configuration as shown in FIG. 1. In this apparatus, a paper feed section 20 feeds a sheet to an image formation section 21, the image formation section 21 prints in the sheet, and the sheet is carried out of a main-body sheet discharge outlet 22. The paper feed section 20 stores sheets of a plurality of sizes in paper cassettes 20*a*, 20*b*, and separates designated sheets on a sheet-by-sheet basis to feed to the image formation section 21. In the image formation section 21, for example, an electrostatic drum 24, and a printing head (laser emitting device), developing device 26, transfer charger 27 and fuser 28 arranged around the drum 24 are disposed, the laser emitting device 25 forms an electrostatic latent image on the electrostatic drum 24, the developing device 26 adds toner to the image, the transfer charger 27 transfers the image onto the sheet, and the fuser 28 heats and fuses the image.

The sheet with the image thus formed is sequentially carried out of the main-body sheet discharge outlet 22. "29" shown in the figure denotes a circulating path, and is a path for two-side printing for reversing the side of the sheet printed on the front side from the fuser 28 via a main-body switchback path 30, then feeding the sheet to the image formation section 21 again, and printing on the backside of the sheet. Thus two-side printed sheet is carried out of the main-body sheet discharge outlet 22 after the side of the sheet is reversed by the main-body switchback path 30.

"31" shown in the figure denotes an image reading apparatus, scans an original document sheet set on a platen 32 with a scan unit 33, and electrically reads with a photoelectric conversion element not shown. For example, the image data is subjected to digital processing in an image processing section, and then, transferred to a data storing section 34, and an image signal is sent to the laser emitting device 25. Further, "35" shown in the figure denotes a document feeding apparatus, and is a feeder apparatus for feeding original document sheets stored in a stacker 36 to the platen 32.

The image formation apparatus A with the above-mentioned configuration is provided with a control section (controller) not shown, and image formation conditions such as, for example, sheet size designation and color/monochrome printing designation and printout conditions such as number-of-copy designation, one-side/two-side printing designation, and scaling printing designation are set from a control panel 38.

Meanwhile, the image formation apparatus A is configured so that image data read by the scan unit 33 or image data transferred from an external network is stored in the data storing section 34, the data storing section 34 transfers the image data to buffer memory 40, and that the buffer memory 40 transfers a data signal to the printing head 25 sequentially.

Concurrently with the image formation conditions, a post-processing condition is also input and designated from the control panel 38. As the post-processing condition, for example, selected is a "printout mode", "staple binding mode", "sheet-bunch folding mode" or the like. The post-processing condition is set for the folding specification in the sheet folding apparatus B as described previously.

[Post-Processing Apparatus]

Figure 4:
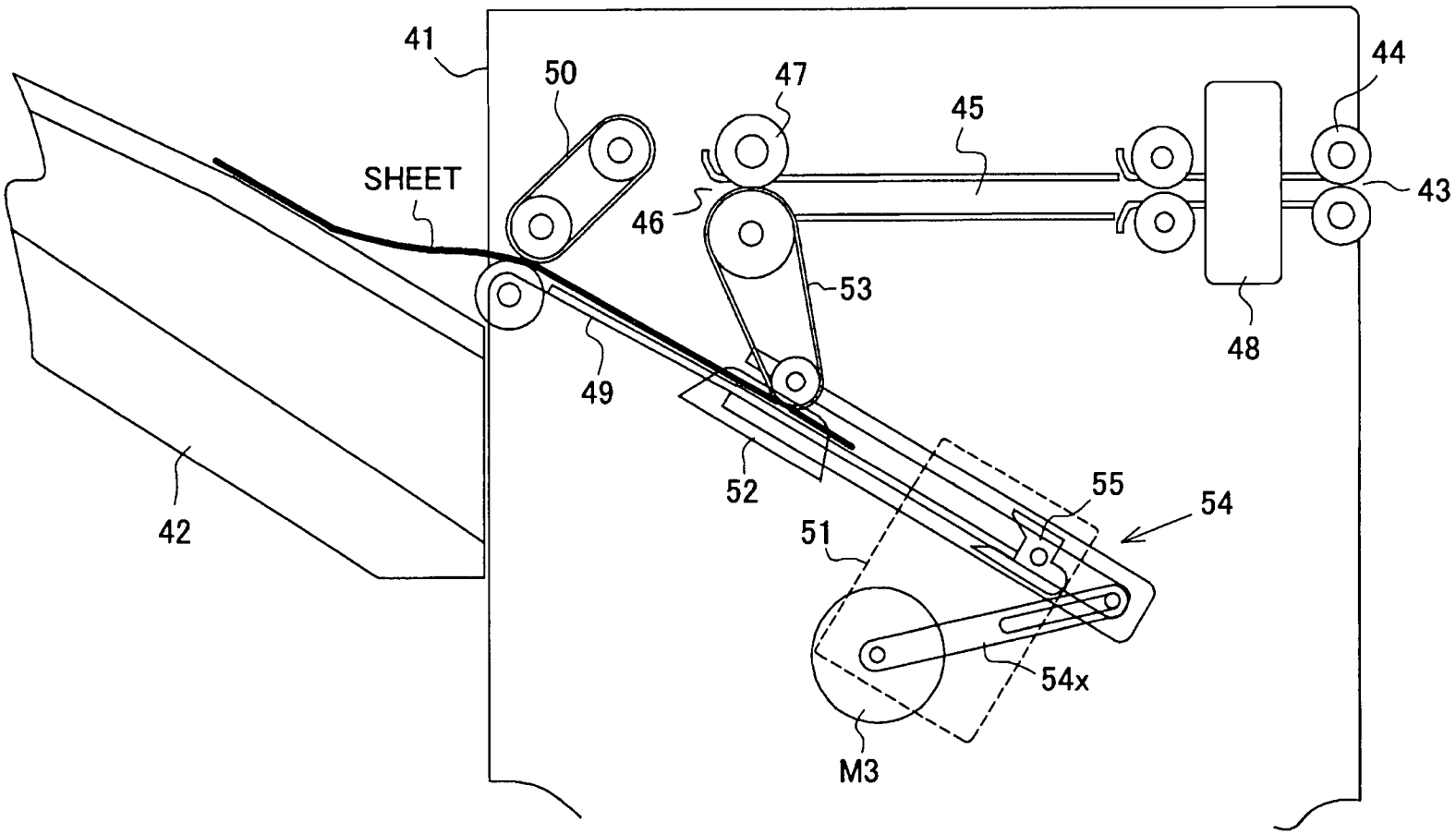
FIG. 4 is an explanatory view showing a configuration of a post-processing unit in the system of FIG. 1.

As shown in FIG. 4, the post-processing apparatus C is provided with the following configuration. This apparatus has a housing 41 provided with the sheet receiving opening 43, sheet discharge stacker 42, and post-processing path 45. The sheet receiving opening 43 is coupled to the carrying-out exit 3 of the sheet folding apparatus B, and is configured to receive a sheet from the first transport path 4 or the third transport path 9.

The post-processing path 45 is configured to guide the sheet from the sheet receiving opening 43 to the sheet discharge stacker 42, and a processing tray 49 is provided in the path. "46" shown in the figure denotes a sheet discharge outlet, and is to collect sheets from the post-processing path 45 in the processing tray 49 disposed on the downstream side. "48" shown in the figure denotes a punch unit, and is disposed in the post-processing path 45. A sheet discharge roller 47 is disposed in the sheet discharge outlet 46 to collect a sheet from the sheet receiving opening 43 in the processing tray 49.

On the processing tray 49, sheets from the post-processing path 45 are switch-back transported (in the direction opposite to the transport direction), and collated and collected using a rear end regulating member (not shown) provided on the tray. Therefore, above the tray is provided a forward/backward rotation roller 50 for switching back the sheet from the sheet discharge outlet 46. Further, the processing tray 49 continues to the sheet discharge stacker 42, and the sheet from the sheet discharge outlet 46 is supported (bridge-supported) on the front end side by the sheet discharge stacker 42 and on the rear end side by the processing tray 49.

On the processing tray 49 is disposed a stapler unit 51 for binding a sheet bunch positioned by the rear end regulating member. "52" shown in the figure denotes an aligning means, and aligns the width of the sheet carried onto the processing tray in the direction orthogonal to the transport direction. "53" shown in the figure denotes a paddle rotating body, and is coupled to a rotary shaft of the sheet discharge roller 47 to be driven to carry the sheet from the sheet discharge roller 47 toward the rear end regulating member.

"54" shown in the figure denotes a sheet bunch carrying-out means, and carries a sheet bunch bound by the stapler unit 51 to the sheet discharge stacker 42 on the downstream side. Therefore, the sheet bunch carrying-out means 54 shown in the figure is comprised of a lever member 54*x* axially supported at the base end portion to be swingable, and a sheet end engagement member 55.

Then, the sheet end engagement member 55 is installed in the processing tray to reciprocate in the sheet discharge direction along the processing tray 49, and is coupled to the lever member 54*x*. "M3" shown in the figure denotes a driving motor for causing the lever member 54*x* to perform swinging motion. In addition, the sheet discharge stacker 42 is provided with an elevator mechanism, not shown, which moves up and down corresponding to a load amount of sheets.

[Action of the Sheet Folding Apparatus]

Figure 5:
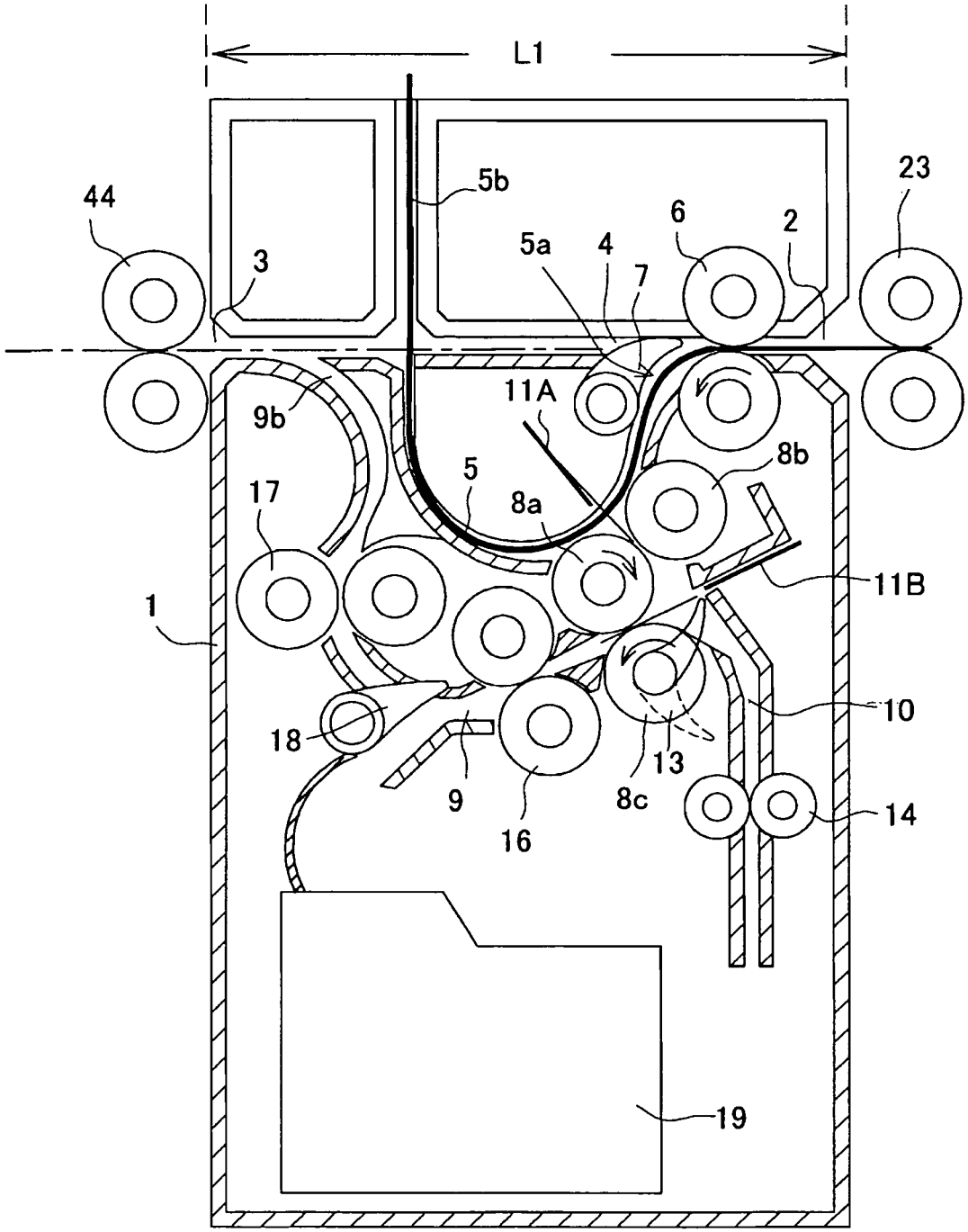
FIG. 5 is an operating state explanatory view of the sheet folding unit of FIG. 2, and shows a state in which a sheet from a carry-in entrance is set in a first-folding position.
Figure 6:
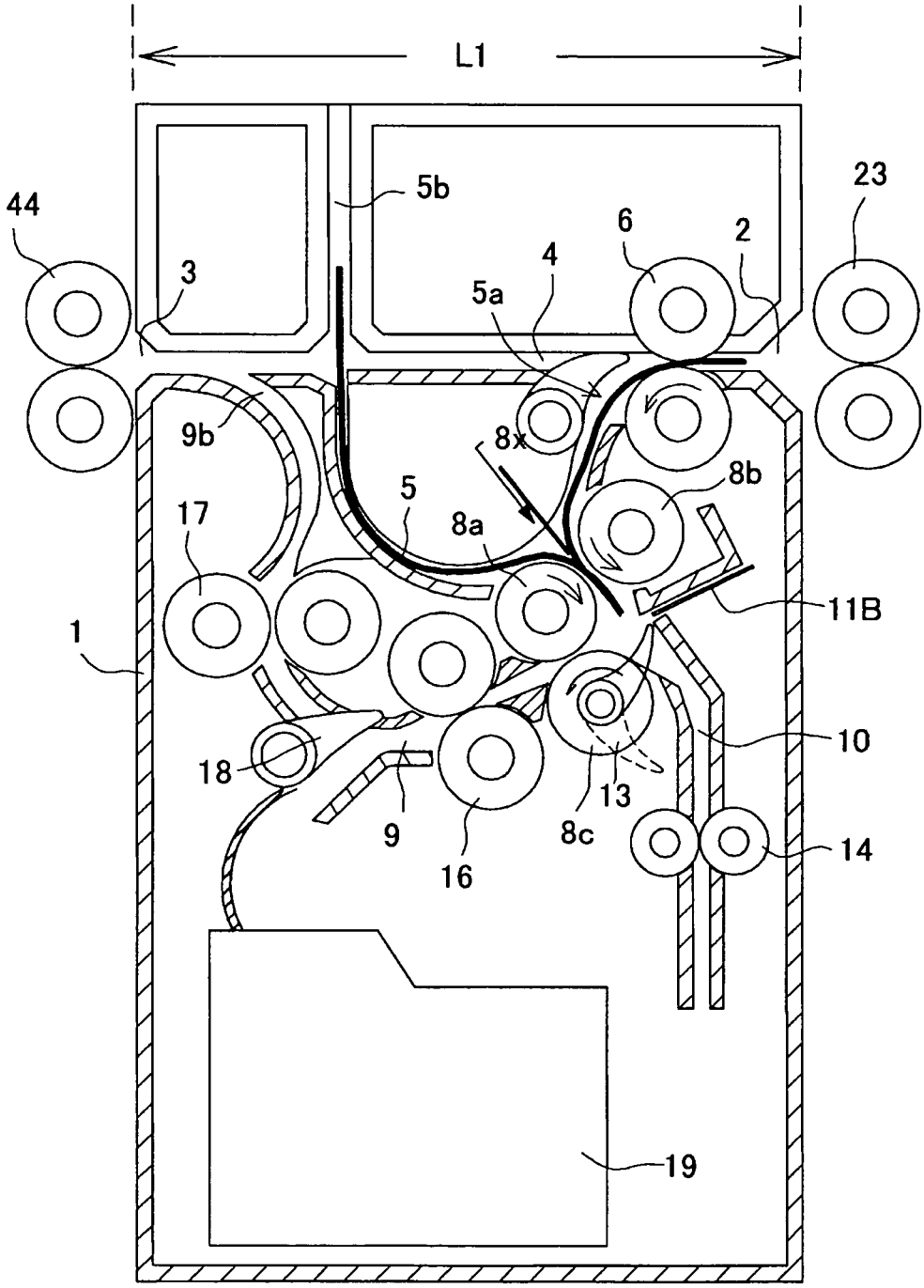
FIG. 6 is another operating state explanatory view of the sheet folding unit of FIG. 2, and shows a state in which the sheet from the carry-in entrance is subjected to first-folding processing.
Figure 7:
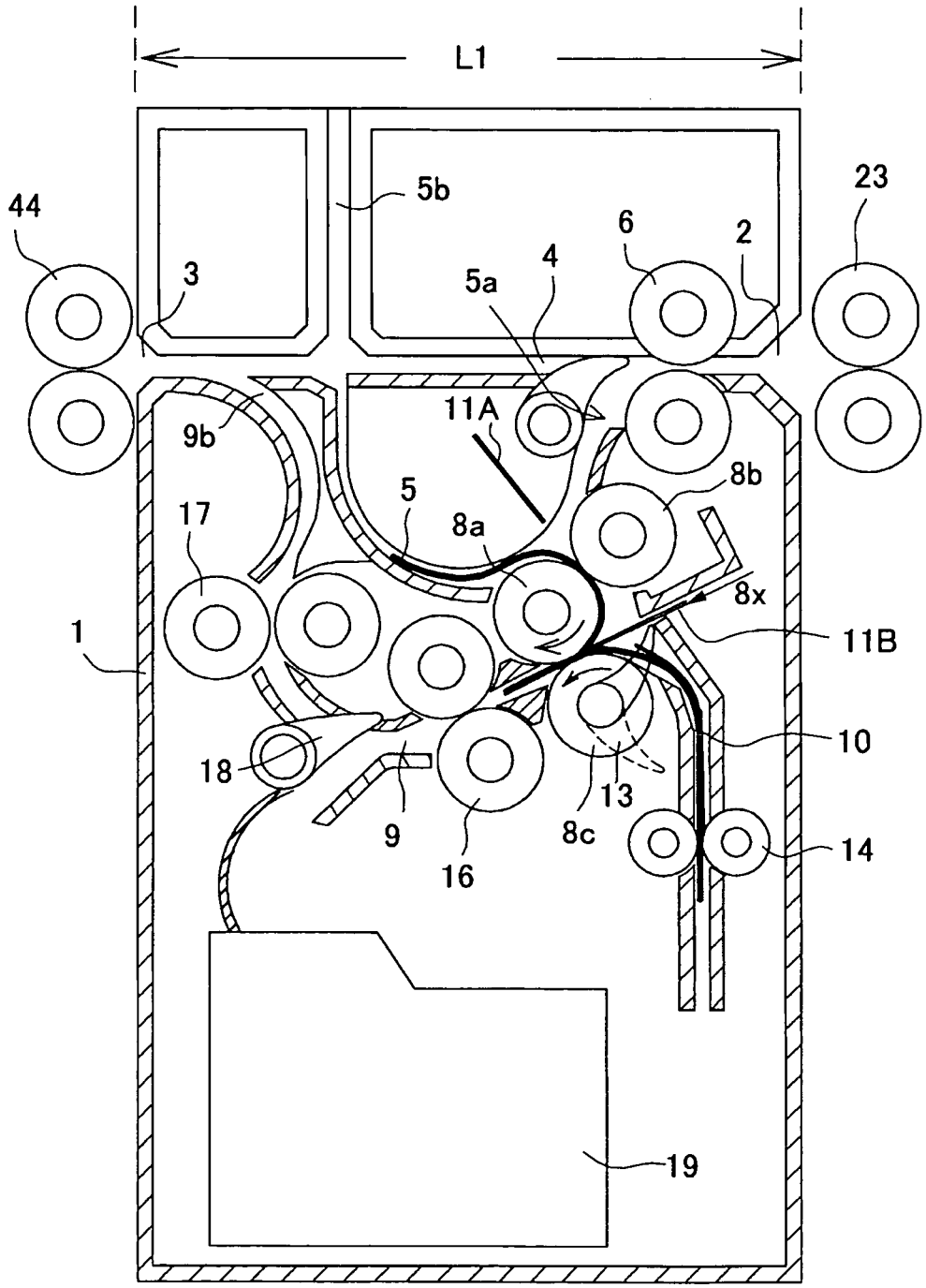
FIG. 7 is still another operating state explanatory view of the sheet folding unit of FIG. 2, and shows a state for performing second-folding processing on the sheet.
Figure 8:
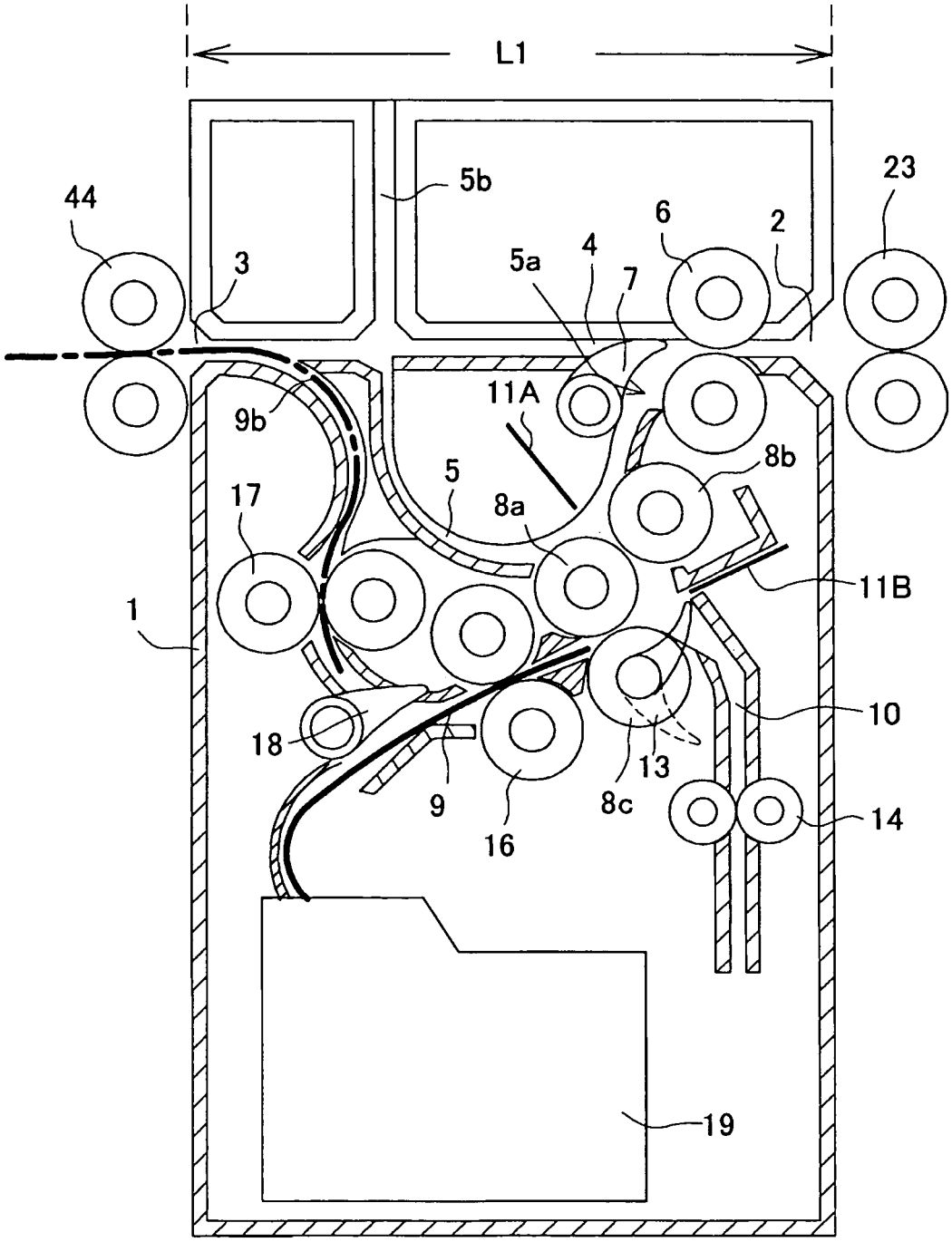
FIG. 8 is still another operating state explanatory view of the sheet folding unit of FIG. 2, and shows a state in which the folding-processed sheet is carried out.

In the above-mentioned configuration, the action of the sheet folding apparatus (unit) will be described. FIG. 5 shows a state in which a sheet is carried in the sheet folding apparatus B. FIG. 6 shows a state in which the sheet is folded (first-folding processing). FIG. 7 shows a state in which the folded sheet is further folded (second-folding processing). FIG. 8 is a state in which the folded sheet is carried out to the downstream side. Each operating state will be described below.

As described previously, with respect to a sheet fed to the carry-in entrance 2 corresponding to a sheet finish condition set in the control panel, the control means installed in the image formation apparatus or sheet folding apparatus guides the sheet fed from the carry-in entrance 2 to the carrying-out exit 3 as shown by the dashed line in FIG. 5 in the sheet discharge mode. Then, the sheet is delivered to the post-processing path 45 of the post-processing apparatus C. The control section of the post-processing apparatus C carries the sheet onto the sheet discharge stacker 42.

In addition, when the staple binding processing is set in the sheet discharge mode, sheets are collected on the processing tray 49 from the post-processing path 45 (see FIG. 1). Then, in the stage in which the image formation apparatus A issues a job finish signal, the sheets on the tray are stapled and bound, and then, the bound sheet bunch is carried out onto the sheet discharge stacker 42.

Meanwhile, when the sheet finish condition is set at the sheet folding processing, the control means sets the path switching means 7 for the state in FIG. 5. Then, the control means rotates the transport roller 6 to guide a sheet from the carry-in entrance 2 to the second transport path 5. Then, the control means controls the rotation of the transport roller 6 to feed and set the sheet into a position such that the fold position of the sheet coincides with the folding position of 8*x* of the path 5. For this positioning, the control means controls the sheet transport position using a front end regulating stopper (not shown) or front end detection sensor disposed in the second transport path 5. FIG. 5 shows a state in which the sheet is set in the folding position 8*x* of the second transport path 5.

Next, the control means rotates the first and second folding rollers 8*a*, 8*b* in the arrow direction in FIG. 6. Concurrently with or slightly after the roller rotation, the control means actuates the shift motor SM to shift the pressing blade 11*a* from the standby position to the operating position. The blade mechanism is shown in FIG. 3 (omitted in FIG. 6), and the sheet set in the predetermined folding position is guided to the nip point of the first and second folding rollers 8*a*, 8*b* by the pressing blade 11*a*, and fed to the downstream side by this roller pair.

Then, in the state as shown in FIG. 6, the control means shifts the path switching means 13 to the solid line state in FIG. 6 when the folding specification is two-folding, while shifting the path switching means 13 to the dashed line state in FIG. 6 when the folding specification is three-folding. Then, the folded sheet is guided to the third transport path 9 in two-folding. Meanwhile, in three-folding, the folded sheet is guided to the folded sheet guide path 10. The sheet fed to the folded sheet guide path 10 is carried to the downstream side by the switchback roller 14, and when the fold position of the sheet rear end coincides with the folding position 8*x* of the folded sheet guide path 10, the control means halts the first and second folding rollers 8*a*, 8*b* and the switchback roller 14.

Then, as shown in FIG. 7, the control means rotates a pair of the first and third folding rollers 8*a*, 8*c* in the arrow direction, and concurrently, rotates the switchback roller 14 in the opposite direction to the prior direction. Subsequently, the control means actuates the folding blade mechanism not shown. Then, the sheet fed to the folded sheet guide path 10 is folded on the rear end side, and fed to the third transport path 9.

Thus the folded sheet is carried out to the stacker 19 or carrying-out exit 3, as shown in FIG. 8. In other words, as shown in FIG. 8, the control means stores the folded sheet that does not need to be carried to the post-processing apparatus C in the stacker 19 disposed in the third transport path 9, while carrying the sheet that needs to be carried to the post-processing C to the carrying-out exit 3 from the third transport path 9. Therefore, the control means controls the path switching means 18 disposed in the third transport path 9.

In addition, in the invention, with respect to the second transport path 5, the case is described that its base end portion 5*a* is disposed below the first transport path 4, and that the path front end portion 5*b* is disposed above the path 4. As an Embodiment different from the aforementioned case, it is possible to place the base end portion 5*a* of the second transport path 5 above the first transport path 4, while placing the path front end portion 5*b* below the first transport path 4. Concurrently therewith, the case is shown that the second transport path 5 branches off from the first transport path 4, and it is also possible to configure the paths so that a path entrance of each of the first and second transport paths faces the sheet carry-in entrance 2.

In addition, this application claims priority from Japanese Patent Application No. 2009-208138 incorporated herein by reference.

What is claimed is:

1. A sheet folding apparatus for performing folding processing on a sheet in a transporting direction from a carry-in entrance toward a carrying-out exit, comprising:

a first transport path for guiding the sheet from the carry-in entrance to the carrying-out exit without performing folding processing;

a second transport path for performing folding processing on the sheet from the carry-in entrance to the carrying-out exit;

a third transport path connected to the second transport path for guiding the folded sheet towards the carrying-out exit in which a transporting direction of the third transport path is in a direction opposite to a transporting direction in the second transport path; and a folding processing device disposed in the second transport path to fold the sheet from the carry-in entrance, wherein the second transport path has a path end portion above the first transport path for guiding a leading end of the sheet to adjust a folding position of the sheet, a nip point disposed below the first transport path where the sheet is nipped by the folding processing device for folding, and a folded sheet guide path upstream of the nip point for guiding the folded sheet under the first transport path, the first transport path is arranged between the path end portion of the second transport path and the folding processing device, and the second transport path is arranged between the carry-in entrance to the carrying-out exit in the transporting direction.

2. The sheet folding apparatus according to claim 1, further comprising:

a stacker disposed below the folding processing device for storing the folded sheet, and a stacker path connected to the third transport path to guide the folded sheet toward the stacker, wherein a transporting direction of the stacker path is in a direction opposite to the transporting direction of the second transport path.

3. The sheet folding apparatus according to claim 2, wherein the carry-in entrance and the carrying-out exit are disposed in positions opposed to each other in an apparatus housing, the first transport path includes a substantially linear path for guiding the sheet from the carry-in entrance to the carrying-out exit, the second transport path includes a substantially loop-shaped path for guiding the sheet from the carry-in entrance to the folding position of the folding processing device, the second transport path being disposed upstream of the stacker, and the third transport path includes a substantially loop-shaped path for guiding the folded sheet from the folding processing device to the carrying-out exit.

4. The sheet folding apparatus according to claim 3, wherein the carry-in entrance and the carrying-out exit are spaced apart from each other in the apparatus housing, the first transport path includes a substantially linear path for guiding the sheet from the carry-in entrance to the carrying-out exit, the second transport path includes a loop-shaped path disposed substantially in a direction same as that of the first transport path, and a rear end portion in a sheet discharge direction of the second transport path is disposed below the first transport path, while the second transport path crosses the first transport path and the path end portion is disposed on a side opposite to the rear end portion.

5. The sheet folding apparatus according to claim 3, wherein the first transport path includes a linear path disposed in a substantially horizontal direction, the second transport path includes a substantially loop-shaped path branching off from the first transport path to guide the sheet to the folding position, and the third transport path includes a substantially loop-shaped path disposed outside of the second transport path to extend along an outer circumferential shape thereof.

6. The sheet folding apparatus according to claim 1, wherein the folding processing device is configured to execute first-folding processing for folding the sheet fed to the first transport path, and second-folding processing for performing folding processing on the sheet subjected to the first-folding processing.

7. The sheet folding apparatus according to claim 1, further comprising a post-processing unit disposed downstream of the carrying-out exit for collating and collecting the sheet from the first transport path and the second transport path to bind with another sheet.

8. An image formation system comprising:

an image formation apparatus for sequentially forming an image on a sheet; and the sheet folding apparatus according to claim 1 for folding the sheet from the image formation apparatus.

9. An image formation system comprising:

an image formation apparatus for sequentially forming an image on a sheet; and the sheet folding apparatus according to claim 2 for folding the sheet from the image formation apparatus.

10. An image formation system comprising:

an image formation apparatus for sequentially forming an image on a sheet; and the sheet folding apparatus according to claim 3 for folding the sheet from the image formation apparatus.

11. An image formation system comprising:

an image formation apparatus for sequentially forming an image on a sheet; and the sheet folding apparatus according to claim 4 for folding the sheet from the image formation apparatus.

12. An image formation system comprising:

an image formation apparatus for sequentially forming an image on a sheet; and the sheet folding apparatus according to claim 5 for folding the sheet from the image formation apparatus.

13. An image formation system comprising:

an image formation apparatus for sequentially forming an image on a sheet; and the sheet folding apparatus according to claim 6 for folding the sheet from the image formation apparatus.

14. An image formation system comprising:

an image formation apparatus for sequentially forming an image on a sheet; and the sheet folding apparatus according to claim 7 for folding the sheet from the image formation apparatus.

15. The sheet folding apparatus according to claim 1, wherein the folded sheet guide path extends from the second transport path for guiding the folded sheet toward the carry-in entrance.

16. The sheet folding apparatus according to claim 1, wherein the third transport path extends from the nip point to the carrying-out exit.

17. The sheet folding apparatus according to claim 16, wherein the folding processing device comprises first, second, and third folding rollers in which the first folding roller is disposed vertically relative to the third folding roller, and the second folding roller is disposed between the first and third folding rollers; and first and second pressing blades.

18. The sheet folding apparatus according to claim 17, wherein the nip point comprises first and second nip points;

the first nip point is located between the first and second folding rollers and is structured so that the first pressing blade pushes a first folding position of the sheet toward the first nip point for a first folding process; and the second nip point is located between the second and third folding rollers and is structured so that the second pressing blade pushes a second folding position of the sheet toward the second nip point for a second folding process.

19. The sheet folding apparatus according to claim 18, wherein the folded sheet guide path is disposed between the first and second nip points so that the sheet folded at the first nip point is guided in a direction toward the carry-in entrance for adjusting the second folding position of the sheet, and then, the folded sheet is guided towards the third transport path, which is in a direction toward the carrying-out exit.

20. The sheet folding apparatus according to claim 1, wherein the first transport path is a substantially linear path situated between the carry-in entrance and the carrying-out exit.

* * * * *